United States Patent [19]

Jones

[11] 4,010,867

[45] Mar. 8, 1977

[54] TWO-PIECE CAN CONSTRUCTION

[75] Inventor: Walter C. Jones, San Pedro, Calif.

[73] Assignee: United Can Company, Fullerton, Calif.

[22] Filed: Feb. 4, 1974

[21] Appl. No.: 439,345

[52] U.S. Cl. ..... 220/66; 220/67; 220/70; 220/72

[51] Int. Cl.[2] ..... B65D 17/02; B65D 17/08

[58] Field of Search ..... 220/1 BC, 66, 67, 72, 220/74, 75, 76, 77, 79

[56] References Cited

UNITED STATES PATENTS

| | | | |
|---|---|---|---|
| 994,468 | 6/1911 | Kane | 220/66 X |
| 2,117,180 | 5/1938 | Kronquest | 220/66 X |
| 2,120,487 | 6/1938 | Conner | 220/66 |
| 2,142,743 | 1/1939 | Calleson | 220/66 X |
| 3,341,059 | 9/1967 | Schild et al. | 220/67 |
| 3,369,694 | 2/1968 | Mauser et al. | 220/67 |
| 3,420,367 | 1/1969 | Carmichael | 220/66 X |
| 3,524,568 | 8/1970 | Nughes | 220/67 |
| 3,608,774 | 9/1971 | Saunders | 220/67 |
| 3,693,828 | 9/1972 | Kneusel et al. | 20/66 |
| 3,814,279 | 6/1974 | Rayzal | 220/67 |
| 3,912,109 | 10/1975 | Essex, Jr. et al. | 220/66 |

FOREIGN PATENTS OR APPLICATIONS

| | | | |
|---|---|---|---|
| 1,344,112 | 10/1963 | France | 220/67 |
| 1,119,542 | 6/1956 | France | 220/66 |
| 893,739 | 10/1944 | France | 220/66 |
| 81,226 | 5/1919 | Switzerland | 220/67 |
| 399,218 | 3/1966 | Switzerland | 220/66 |

*Primary Examiner*—William Price
*Assistant Examiner*—Stephen Marcus
*Attorney, Agent, or Firm*—Knobbe, Martens, Olson, Hubbard & Bear

[57] ABSTRACT

A two-piece can and method for making the same wherein the cup portion has a bottom panel integral with the sidewall. The interface of the bottom panel with the sidewall in the cup has a wall bead which is of the same outside configuration as the connection of the upper rim of the cup to the separate top panel. The bottom panel in the cup portion has a specific profile to withstand the internal pressures within the can during the recooking phase of the substance sealed within the can. The profile has a bottom bead which is closely adjacent the interface of the bottom panel with the sidewall and has a very tight radius between the sidewall and the bead to provide a strengthening rib for the prevention of buckling during the reheating phase.

10 Claims, 8 Drawing Figures

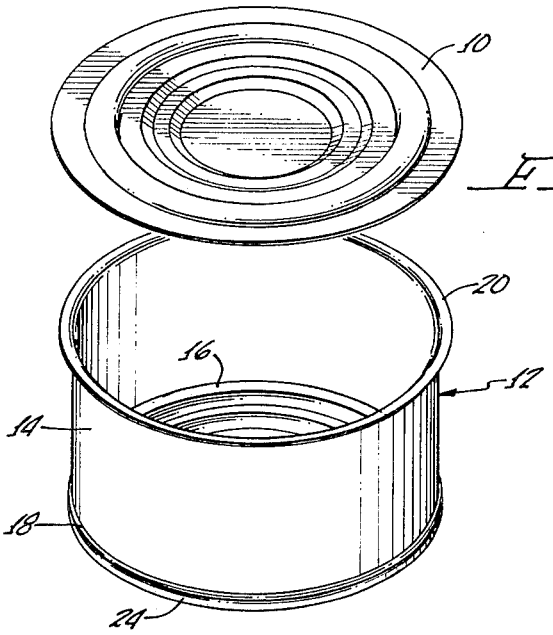
FIG. 1.
FIG. 2.
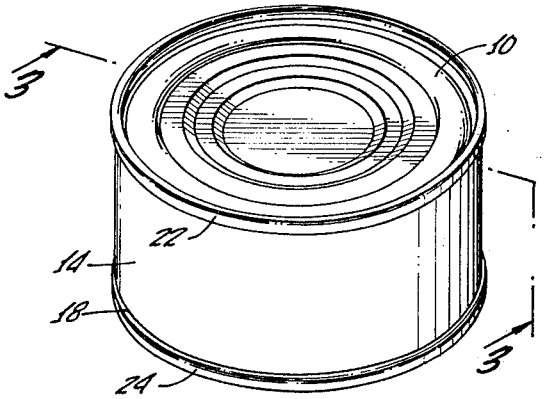
FIG. 3.
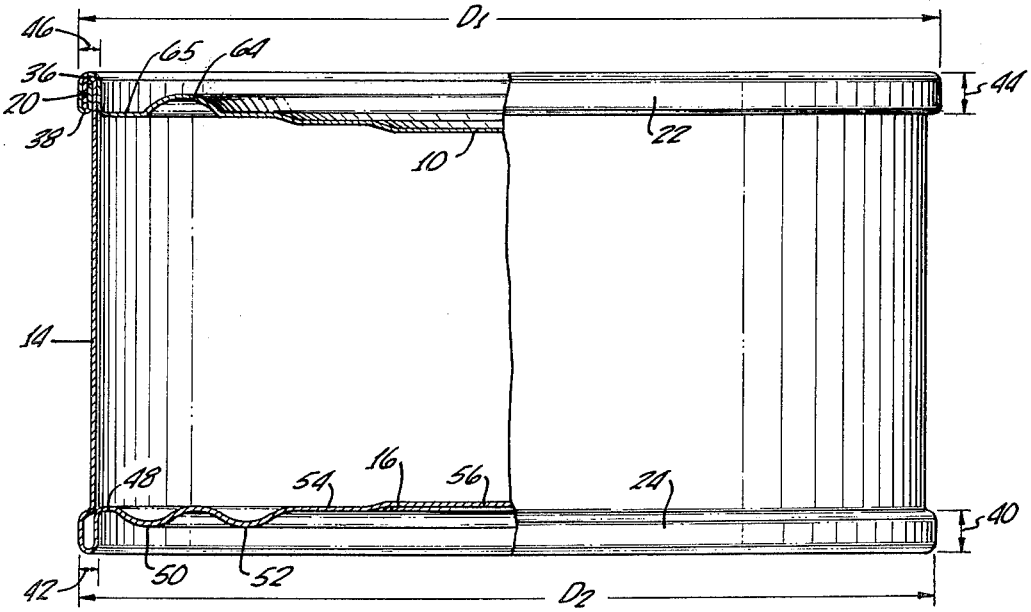

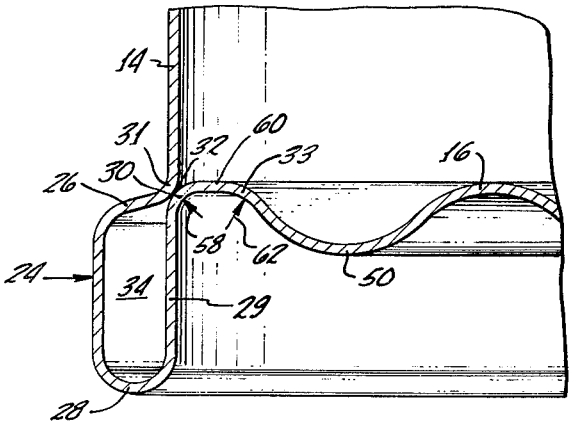
FIG. 4.
FIG. 5.
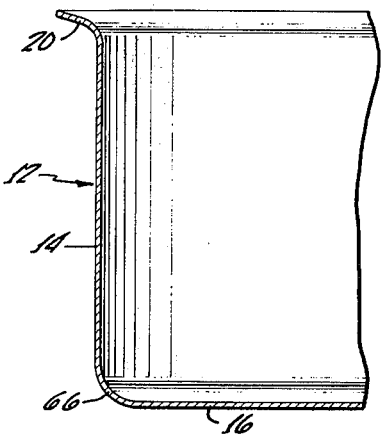
FIG. 6.
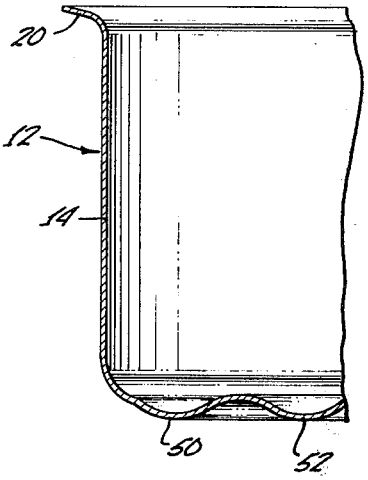
FIG. 7.
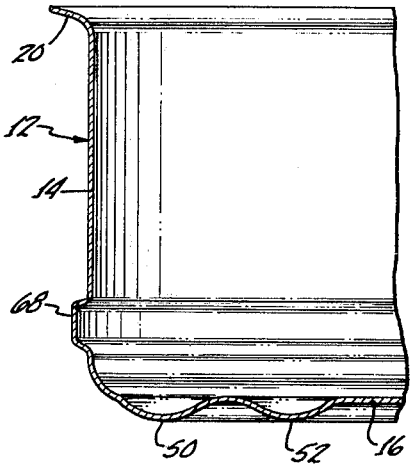
FIG. 8.
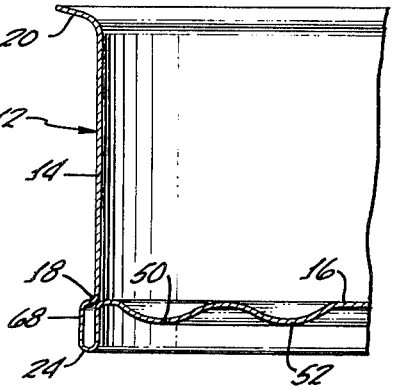

TWO-PIECE CAN CONSTRUCTION

BACKGROUND OF THE INVENTION

This invention relates to the field of can construction and more specifically deals with the construction of two-piece cans for use in the sealing of perishable foods. A trend has developed in the industry to utilize two-piece cans with their associated advantage of less joints in the manufacturing steps.

In the prior art three-piece cans were used primarily for the sealing of perishable foods. This type of construction results in a double seam around the interface of the top and bottom panels with the sidewall. This double seam extends outside of the sidewall. The prior art two-piece cans utilize a cup portion to connect with a top panel forming a double seam near the upper end. However, the cup portion in many instances has a smooth interface with the bottom panel, or has a bead significantly different from the double seam. Such a construction poses problems with respect to the present machinery utilized by canners in their canning operations designed originally for three-piece cans. One problem relates to the fact that the labeling machines do not incorporate apparatus to position the cans in any particular orientation with regard to a top or bottom. Since in three-piece cans the double seam at both ends of the sidewall are exactly the same, the can can be placed in either of two orientations for the placement of the label. It is necessary that the two double seams have essentially the same outside configuration with similar lip flanges, so that regardless of the can orientation when the label is attached to the can whichever double seam bead that is at the top of the label will accommodate a typical household can opener.

A further problem with prior art two-piece cans is that, when perishable foods are sealed within a can, the normal processing requires a recooking of the substance within the can after the can has been sealed. Consequently, it is necessary that the end panels be of such configuration and strength to withstand a certain amount of bulging as the interal pressure increases under the recooking. In the normal three-piece can construction the gauge of metal used for the end panels is greater than that used for the sidewalls. However, in two-piece can construction one of the end panels must be of the same gauge metal as the sidewall. Therefore, in the prior art two-piece cans the lighter gauge metal used in the sidewall, which is also the same as for one of the end panels, is not sufficient in strength to withstand the bulging and permanent buckling may result. This is attributable in large part to the fact that the normal three-piece can has end panels, incorporating standard profiles which are quite adequate for the heavier gauge metal to prevent buckling, but are inadequate for the lighter gauge metal used in two-piece cans.

When packaging three-piece cans in cartons for shipment, the double seams of respective adjacent cans mate with each other and provide protection to the labeling of the can during the shipment. In the prior art two-piece can construction where only one end of the can has a double seam, the packaging of the cans in cartons for shipment results in a loose orientation between the cans at one end, resulting in the cans hitting each other on the labels and damaging these labels.

A primary concern of canners is the ability to utilize their present machinery with two-piece cans as well as three-piece cans in order to allow them to phase in the use of two-piece cans. The prior art two-piece cans do not provide this flexibility, since their construction utilizes only one double seam and, therefore, the canning machinery would require some mechanism to orient the cans, so that the double seam for use with can openers will be adjacent the top of the label. However, canners in many instances would like to maintain the ability to interchange the use of three-piece and two-piece cans rather than orienting their machinery to a particular two-piece can configuration as shown by prior art two-piece cans. This interchangeability with normal three-piece cans has not been achieved with prior art two-piece cans, as prior methods of making two-piece cans have not resulted in a can having a bottom bead similar in configuration to the double seam.

SUMMARY OF THE INVENTION

The present invention utilizes the cup portion wherein one end of the can is integral with the sidewall and wherein the interface of this one end with the sidewall is designed to produce a wall bead of similar configuration as the double seam produced by the connection of the top panel to the upper flange of the sidewall. Consequently, the two-piece can of this invention results in an outward appearance similar to the typical three-piece can. This allows the canners to utilize the two-piece can with their present machinery designed for three-piece cans, eliminating the concern for the orientation of the can as was the case with prior art two-piece cans, because either end of the two-piece can is able to accommodate a typical household can opener, such as the electric type which is used to remove either end panel.

The present two-piece can invention utilizes a specific bottom profile on the bottom panel of the cup portion in order that the can will withstand the internal pressures caused in the recooking phase of the canning process. Since the gauge of metal used in the bottom of the cup portion will be the same as the lesser gauge metal used in the sidewall, it is necessary that the design of the bottom panel be such to provide strength to withstand the pressures associated with internal cooking. This profile utilizes a bottom bead closely adjacent the wall bead at the interface of the bottom panel and the sidewall. Between the bottom bead and the wall bead of the bottom panel is a tight radius or semicircular turn which represents a strengthening rib around the bottom panel to prevent possible buckling of the bottom panel as its bulges during the recooking phase. This enables the two-piece can to utilize in the bottom panel the thinner gauge metal as is used in the sidewall panel.

The configuration of the two-piece can shown herein allows the canners presently using three-piece cans to also incorporate the use of two-piece cans in their present machinery. There is the ability to interchange the use of three-piece cans with the use of two-piece cans.

BRIEF DESCRIPTION OF THE DRAWINGS

FIG. 1 is an exploded perspective view of a cup portion and the top panel of the two-piece can;

FIG. 2 is a perspective view of the two-piece can;

FIG. 3 is a partial sectional view taken along the lines 3—3 in FIG. 2;

FIG. 4 is a detailed sectional view showing the wall bead and bottom strengthening rib; and FIGS. 5 through 8 schematically show a method of making the two-piece can construction.

DETAILED DESCRIPTION OF THE INVENTION

FIG. 1 shows the components of a two-piece can, including a top panel or plate 10 and a cup portion 12 which is comprised of a sidewall or cylindrical portion 14 with a bottom panel or plate 16 integrally attached to the sidewall 14 at the interface 18. Along the upper portion of the sidewall 14 is a connecting flange 20 for connection with the top panel 10.

Referring to FIG. 2, the connection of the top panel 10 to the connecting flange 20 of the sidewall 14 produces a double seam or upper lip 22 which extends beyond the sidewall 14. The interface 18 between the bottom panel 16 and the sidewall 14 produces a wall bead or lip 24 which has the same outside configuration as the double seam 22. Referring to FIG. 3, the diameter D1 of the double seam 22 is the same as the diameter D2 of the wall bead 24. This results in the two-piece can having essentially the same configuration as a three-piece can with the characteristic upper and lower double seams or lips.

FIG. 3 shows the interface of the bottom panel 16 and the sidewall 14 as well as the connection between the upper flange 20 and the top panel 10. In the process of making the two-piece can, the bottom panel 16 is recessed up within the sidewall 14 to produce the wall bead 24.

As shown in FIG. 4, the wall bead 24 has a slight sloping surface 26 projecting away from the sidewall 14 and then extends straight down. At the lower portion 28 of the wall bead 24 it curves in a general semicircular cross-sectional shape upward to an inner wall 29 which proceeds straight upward and terminates into a turn 30 whose convex side is adjacent the convex side of the curve 31 located at the intersection of the sloping surface 26 and the sidewall 14. The turn 30 of the bead and the curve 31 of the bead with the sidewall are in contact at line 32 to seal the void area 34 formed by the outside configuration of the wall bead 24.

With respect to FIG. 3, the intersection of the top panel 10 with the flange 20 of the sidewall 14 is shown. The flange 20 has a downward extending L-shape edge 36 while the top panel 10 has an upward extending U-shaped edge 38 which mates with the L-shaped edge of the flange to form the double seam 22. The resulting double seam 22 is essentially duplicated in outward appearance by the wall bead 24. The height 40 and thickness 42 of the wall bead 24 is the same as the height 44 and thickness 46 of the double seam 22 in order that both the wall bead and the double seam can accommodate a typical household can opener.

Punched within the bottom panel 16 is a bottom profile comprising a strengthening rib 48, a first bottom bead 50, a second bottom bead 52, step panel 54, and a center panel 56. This configuration of a bottom profile is designed not only to provide expansion in the bottom when internal pressure is exerted on the bottom panel during the recooking phase of the canning process once the can has been sealed, but also to allow the bottom to recede when the vacuum is created after cool down. The metal used for the sidewall 14 is typically a lighter gauge metal such as 75 pound gauge which in the case of a two-piece can is also the gauge of the bottom panel 16.

The incorporation of the bottom profile with the strengthening rib 48 allows the bottom panel to accommodate the significant pressures within the can associated with the recooking process.

As shown in FIG. 4, the strengthening rib 48 has a tight radius 58 which provides the strength needed to withstand any possible buckling of the bottom panel. The rib 48 continues with a slight flat portion 60 and then another radius 62 slightly larger than the tight radius 58. The flat portion 60 is necessary in order to permit the incorporation of the smaller radius 58 of turn 30 in the manufacturing process of fabricating the two-piece can. Otherwise, if the smaller radius turn 30 is connected directly with the larger radius turn 33, the placement of the turn 30 tightly adjacent the turn 31 would be hampered.

It has been determined that the tight radius 58 of approximately 0.030 inch for the turn 30 is an optimum size, because this smaller provides additional strength to the strengthening rib 48 to prevent the turn 30 from pulling away from the turn 31, permanently buckling the can. Larger radii do not seem to provide the adequate strength. It has also been determined in practice that 0.04 inch is optimum for the larger radius 61. A single radius of approximately 0.030 inch for a complete semicircle rather than the two different radii 58 and 62 would not be satisfactory because the bend or rib 48 would be too tight and, although it would provide strength to prevent buckling during the expansion phase, it would be too rigid to allow for the retraction of the bottom when the vacuum is created within the can after cool down. Consequently, the use of the two different sized radii gives the most optimum design to accommodate both the expansion forces and the contraction forces. The smaller radius turn 30 provides strength to prevent buckling while the slightly larger radius turn 33, although providing strength, provides slightly more flexibility to permit the bottom to recede properly after cool down.

The bottom beads 50 and 52 are incorporated in the end panel to accommodate the outward expansion of the panels 54 and 56. In other words, the bottom beads 50 and 52 act in somewhat on the same principle as an accordion while the panels 54 and 56 go outward during cooking and inward during cool down. It should be noted that the number of bottom beads will vary according to the size can being made. In small cans only one bottom bead may be used while in larger cans three or four may be used. Since buckling in the can would cause the bottom panel 16 to pull away from the sidewall 14, permanently damaging the can, the step panels 54 and 56 acting in conjunction with the bottom beads 50 and 52 and the strengthening rib 48 allow for the bulging of the can during recooking and cause the can to return to its original shape after recooking has been completed.

The typical pressure experienced by a can during the recooking phase of the processing is in the neighborhood of about 25 pounds. In the case of a two-piece can construction with a standard bottom profile which is used on typical three-piece cans the bottom panel can only withstand approximately 23 or 24 pounds pressure. However, with the use of the new bottom profile with the strengthening rib 48 the bottom panel 16 can withstand pressures in the neighborhood of 32 pounds using the 75 pound gauge metal.

It should be noted that the number of step panels 32 will depend upon the diameter of the can.

A standard top or bottom panel profile used in three-piece cans is shown on the top panel 10 in FIGS. 1–3. When comparing this standard profile with the new profile, note is taken of the closer orientation of the bottom panel bead 50 to the sidewall 14 with the new profile resulting in the strengthening rib 48 as compared to the location of the panel bead 64 on the standard profile with the relatively large flat portion 65.

Turning to one method for constructing the two-piece can discussed above attention is directed to FIGS. 5–8. In FIG. 5 the first step is to draw and cut the basic cup portion 12, having a smooth interface 66 between the sidewall 14 and the bottom panel 16 as in prior art two-piece cans. FIG. 6 shows the second step, which is to punch press and stamp the profile in the bottom panel 16 with the bottom bead 50. FIG. 7 reflects the third step in the development of the cup portion 12 of the two-piece can which involves the forming of a sidewall bead 68 in the sidewall 14 of the can. FIG. 8 shows the final step in forming the cup portion by recessing the bottom panel 16 to produce from the sidewall bead 68 or lower wall bead 24 along the bottom edge of the sidewall 14 at the interface 18 of the sidewall 14 and the bottom panel 16. To complete the can, a top panel is connected to the flange 20 of the cup portion after the material to be stored is placed in the cup portion. It should be noted that in some instances it may be preferable to incorporate the second step of punching the profile in the bottom panel 16 into the final step of recessing the bottom panel 16, especially when using the thinner gauge metals.

What is claimed is:

1. A two-piece can comprising:

a first piece having a cylindrical sidewall portion and an integral bottom panel portion;

a plate attached to the end of said cylindrical portion opposite side bottom panel;

a first circumferential lip formed along the attachment of said plate to said cylindrical portion; and a second circumferential lip formed along the intersection of said bottom panel and said cylindrical portion, said first and second lips having substantially the same cross sectional shape with two separated flat portions joined at one end by a curved portion, at least one of said flat portions on said first and second lips extending away from said plate and said bottom panel respectively in a direction generally parallel to the longitudinal center of said can.

2. A two-piece can as defined in claim 1 wherein said bottom panel is slightly recessed within said cylindrical portion to form said second lip.

3. A two-piece can as defined in claim 1 wherein said first and second lips extend beyond said cylindrical sidewall and respectively beyond said plate and said panel, so that any can opener which cooperates with said first lip to open said can will also cooperate with said second lip to open said can.

4. A two-piece can as defined in claim 1 wherein said integral bottom panel portion has a profile comprising:

a first tight radius turn adjacent said second lip convex radially outward toward the sidewall;

a flat portion essentially perpendicular to said sidewall and extending in toward the center of said can from said first tight radius turn;

a second tight radius turn slightly larger than said first tight raduis turn, being connected to said flat portion and being convex inward toward said center of said can;

a bottom bead extending toward the center of said bottom panel and being convex outward from the interior of said can; and a series of step panels extending from said bottom bead toward the center of said bottom panel.

5. A two-piece can as defined in claim 4 wherein said cylindrical portion and said bottom panel are fabricated with 75 gauge metal to prevent permanent buckling of said bottom panel when subjected to 32 pounds internal pressure within said can.

6. A two-piece can comprising:

a sidewall portion;

a bottom section integrally formed to said sidewall portion; and a top section connected to said sidewall portion, said attachment of said bottom section to said sidewall portion and said connection of said top section to said sidewall portion forming respective top and bottom lips on said two-piece can, said top and bottom lips having substantially the same height and thickness.

7. A two-piece can for preservation of perishables, comprising:

a cylindrical wall section;

a top section connected to said wall section, said connection of said top section to said wall section resulting in an upper flange around said can;

a bottom section; and lip means integrally forming said bottom section with said wall section for receiving a typical household can opener to open said bottom section, said flange receiving said can opener to open said top section.

8. A two-piece can comprising:

a cup unit having an end open;

a flange along said open end of said cup unit;

a first plate integral with and recessed within said cup unit forming a bottom to said cup unit, the intersection of said first plate with said cup unit forming a first bead said first bead extending outward a specified distance away from said first plate in a direction generally parallel to the longitudinal center of said cup; and a second plate for connection to said flange forming a second bead having an exterior configuration similar to said first bead, said second bead extending outward a distance away from said second plate in a direction opposite said direction of said first bead a distance equal to said specified distance of said first bead.

9. A sealable two-piece can comprising:

a body section;

a first panel integrally connected to one end of said body section, said first panel and said body section forming a cup-like arrangement; and a second panel attached to the other end of said body section, said second panel recessed within said other end of said body section forming a first flange along said attachment of said second panel to said other end of said body section, said first panel recessed within said one end of said body section with the same configuration as said recessed second panel, said integral connection of said first panel to said one end of said body section forming a second flange, said first flange receiving a typical household can opener to open said second panel, said second flange receiving said can opener to open said first panel.

10. A two-piece can comprising:

a sidewall section having a cylindrical shape;

an upper surface panel connected to one end of said sidewall section, forming a top section of said can perpendicular to said sidewall sectional; and a lower surface panel integrally connected to the other end of said sidewall section, forming a bottom section of said can perpendicular to said sidewall section, said lower surface panel having a profile with a recessed strengthening rib formed in said lower surface adjacent said sidewall section, cross-section of said recessed rib having a first tight radius, a generally flat area and a second tight radius, said first tight radius being convex toward the interior and said sidewall section of said can, said second tight radius being convex toward the center and interior of said can, said profile having a bottom bead, the width of said flat area in said strengthening rib being smaller than the width of said bottom bead.

* * * * *

UNITED STATES PATENT OFFICE

CERTIFICATE OF CORRECTION

PATENT NO. : 4,010,867

DATED : March 8, 1977

INVENTOR(S) : Walter C. Jones

It is certified that error appears in the above-identified patent and that said Letters Patent are hereby corrected as shown below:

Column 2, line 53, change "its" to ---it---.
Column 4, line 19, after "smaller" insert ---radius---; line 24, change "61" to ---62---.
Column 5, line 38, change "side" to ---said---.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*